United States Patent [19]

Iigami

[11] Patent Number: 4,725,758

[45] Date of Patent: Feb. 16, 1988

[54] PHOTOCATHODE

[75] Inventor: Yoshiki Iigami, Shizuoka, Japan

[73] Assignee: Hamamatsu Photonics K.K., Shizuoka, Japan

[21] Appl. No.: 872,289

[22] Filed: Jun. 10, 1986

[30] Foreign Application Priority Data

Jul. 19, 1985 [JP] Japan ..... 60-159766

[51] Int. Cl.[4] ..... H01J 40/06

[52] U.S. Cl. ..... 313/542

[58] Field of Search ..... 313/542

[56] References Cited

U.S. PATENT DOCUMENTS

| | | | |
|---|---|---|---|
| 2,242,395 | 5/1941 | Hartmann et al. | 313/542 X |
| 3,006,786 | 10/1961 | Sjoberg | 313/542 X |
| 4,196,257 | 4/1980 | Engstrom et al. | 313/542 X |

FOREIGN PATENT DOCUMENTS

| | | | |
|---|---|---|---|
| 59-11181 | 1/1984 | Japan . | |
| 434515 | 11/1974 | U.S.S.R. | 313/542 |

OTHER PUBLICATIONS

Sommer, A.; "Photo-Emissive Materials," (John Wiley Sons Inc., 1968) pp. vii-ix, 133-140.

*Primary Examiner*—Palmer C. DeMeo

*Attorney, Agent, or Firm*—Finnegan, Henderson, Farabow, Garrett and Dunner

[57] ABSTRACT

A photocathode including a first silver layer formed on a transparent substrate by vacuum deposition, a silver oxide layer formed in such a manner that oxygen gas is introduced and electric discharge is caused in the oxygen gas thus introduced to oxide the surface of the first silver layer, a potassium layer formed on the silver oxide layer in such a manner that the substrate and the first silver layer are heated and potassium is vacuum-deposited on the silver oxide layer, a sodium layer formed on the potassium layer by vacuum-depositing sodium with the potassium layer heated, a second silver layer formed on the sodium layer by vacuum-depositing silver, a cesium layer formed on the second silver layer by vacuum-depositing cesium, and a third silver layer formed on the cesium layer by vacuum-depositing silver.

1 Claim, 4 Drawing Figures

PHOTOCATHODE

BACKGROUND OF THE INVENTION

The present invention relates to a photocathode and to a method of manufacturing a photocathode.

A photocathode having an optical response in the infrared range and which is made of silver, oxygen and cesium (Ag-O-Cs) is well known in the art. Such a photocathode is described in Sommer, A.: "Photo-emissive Materials" (John Wiley and Sons Inc., 1968). As discussed at pages 134 to 140 of this publication, the most suitable thickness of the silver film layer is in a range of 100 to 200 Å. A photocathode formed accordingly has an optical response in the infrared range up to a wavelength of 1.2 microns.

The present inventor has proposed a photocathode which is made of silver, silver oxide, potassium and cesium and which is sensitive at longer wavelengths than that in which the aforementioned silver-oxygen cesium photocathode is sensitive, and also disclosed a method of manufacturing such a photocathode (see Japanese Patent Application Publication No. 11181/1984). In the wavelength range in which the silver oxygen-cesium photocathode is sensitive, the photocathode previously proposed by the present inventor is more sensitive and has an optical response in the wavelength range of up to 1.7 microns. Thus, the photocathode previously proposed by the inventor is considerably sensitive in the infrared range; however, it is still disadvantageous in that, when it is used in a spectrum analyzer or the like, the gain is variable.

SUMMARY OF THE INVENTION

Accordingly, an object of this invention is to provide a photocathode which is at least as sensitive in the infrared range as the photocathode previously proposed by the inventor but which has a smaller gain variation.

Another object of the invention is to provide a method of manufacturing such a photocathode.

The foregoing objects and other objects of the invention have been achieved by the provision of a photocathode which according to the invention, is made of silver, silver oxide, potassium, sodium, and cesium, and by the provision of a method of manufacturing such a photocathode which, according to the invention, comprises: a first silver layer forming step in which a first silver layer is formed by vacuum-depositing silver on a transparent substrate; a silver oxide layer in which oxygen gas is introduced and electric discharge is caused in the oxygen gas thus introduced to oxidize the surface of the first silver layer to form a silver oxide layer; a potassium layer forming step in which the substrate and the first silver layer are heated and potassium is vacuum-deposited on the silver oxide layer; a sodium layer forming step in which the potassium layer is heated and sodium is vacuum-deposited to form the sodium layer on the potassium layer; a second silver layer forming step in which silver is vacuum-deposited on the sodium layer; a cesium layer forming step in which cesium is vacuum-deposited on the second silver layer; and a step of forming a third silver layer on the cesium layer.

The nature, principle and utility of the invention will become more apparent from the following detailed description and the appeared claims when read in conjunction with the accompanying drawings.

DESCRIPTION OF THE PREFERRED EMBODIMENTS

Figure 2:
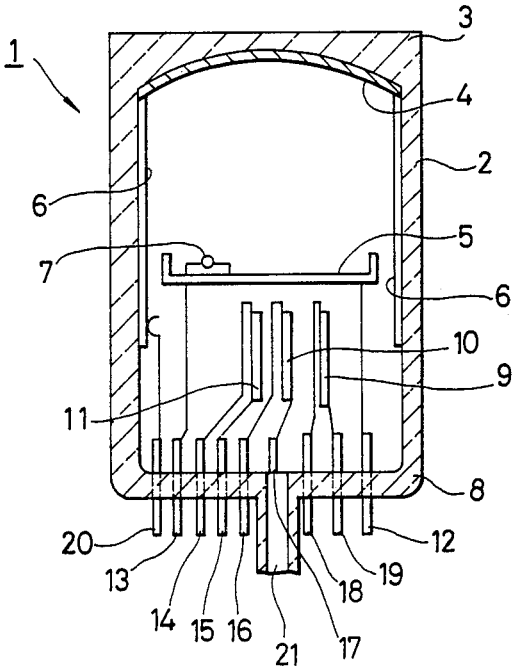
FIG. 2 is a sectional view used for a description of the manufacture of a photoelectric tube in which the photocathode of the invention is formed.

FIG. 2 is a sectional view illustrating the manufacture of a photoelectric tube 1 in which a photocathode 4 is to be formed.

The photoelectric tube 1 has a cylindrical airtight bottomed container 2 made of glass. The photocathode 4 is formed on the face plate of the container 2, or on the inner surface of the photocathode substrate 3 of the container 2. A plate-shaped anode 5 is disposed in the container 2 confronting the photocathode 4.

A thin chromium layer 6 is formed on the part of the inner surface of the side wall of the container which is located between the substrate 3 and the anode 5. The chromium layer is a conductor used to supply current to the photocathode 4 and to intercept unwanted light which enters the container 2 through its side wall. A silver pellet 7 secured to a Nichrome wire is arranged on the surface of the anode 5 which confronts the photocathode 4. One end of the Nichrome wire is connected to a lead pin 13 and the other anode 5.

A sodium container 9, a cesium container 10, and a potassium container 11 are provided between the anode 5 and a stem plate 8 which confronts the photocathode substrate 3 through the anode 5. Lead pins 12 through 20 are embedded in the stem plate 8 in such a manner that they form a circle. A gas evacuating pipe is formed at the center of the stem plate 8. The photocathode 4 is electrically connected to the lead pin 20 through the chromium layer 6. The anode 5 is electrically connected to the lead pin 12.

Sodium chromate, zirconium and tungsten are contained in the sodium container 9, which is a cylinder made of tantalum foil. One end of the sodium container 9 is connected to the lead pin 18 and the other end to the lead pin 19. Cesium chromate, zirconium and tungsten are contained in the cesium container 10, which is also a cylinder made of tantalum foil. One end of the cesium container 10 is connected to the lead pin 16 and the other end to the lead pin 17.

Potassium chromate, zirconium and tungsten are contained in the potassium container 11, which is also a cylinder made of tantalum foil. One end of the potassium container 11 is connected to the lead pin 14 and the other end to the lead pin 15.

Air is discharged through the gas evacuating pipe 21 from the airtight container 2, and the degree of vacuum therein is maintained at $10^{-6}$ Torr.

During the manufacture of the photocathode 4, the optical sensitivity of the photocathode is measured as necessary. The measurement is carried out as follows: A voltage of 50 to 150 V is applied to the anode 5 with respect to the photocathode 4. Under this condition, photoelectrons produced by the application of light having a suitable standard intensity are collected at the anode 5 and applied to the lead pin 12 for measurement.

The steps of forming the photocathode 4 will be described with reference to FIG. 2.

(1) In order to purify the inside of the tube 1, the tube is heated from the outside at a temperature of 300° C. for about one hour.

(2) After the tube 1 has cooled to room temperature, silver is vacuum-deposited on the inner surface of the face plate 3 using the silver pellet 7. Vacuum deposition is carried out until the formed silver flim layer turns reddish violet.

(3) Pure oxygen gas is introduced into the tube 1, and a high frequency electric discharge is caused in the oxygen gas to oxide the silver film layer. In this operation, the pressure of the oxygen gas is about 1 Torr. The high frequency electric discharge is carried out with one of the output terminals of a high-frequency voltage generator connected to the anode 5 and the other output terminal connected to an electrode set near the outer surface of the face plate 3.

(4) The oxygen gas is discharged.

(5) The tube 1 is heated at 200° C., for instance. The heating temperature may be in the range of 150° to 250° C.

(6) A voltage is applied across the lead pins 14 and 15 to effect the emission of potassium from the potassium container 11. The potassium thus emitted is adsorbed by the silver film layer. The emission of potassium is continued until the color of the silver film layer becomes red. In this operation, the photocathode 4 is formed and the optical sensitivity reaches a peak.

(7) A voltage is applied across the lead pins 18 and 19 to effect the emission of sodium from the sodium container 9. The sodium thus emitted is adsorbed by the photocathode 4. This operation is continued until the sensitivity of the photocathode reaches a peak.

(8) Current is applied to the silver pellet 7 through the lead pins 12 and 13. In this case, it is observed that the optical sensitivity of the photocathode 4 becomes zero.

(9) The tube 1 is heated, for instance, at a temperature of 100° C. The heating temperature may be in the range of 70° to 150° C.

(10) A voltage is applied across the lead wires 16 and 17 to cause the cesium container 10 to emit cesium. The cesium thus emitted is adsorbed by the photocathode 4. This operation is continued until the color of the photocathode 4 becomes gray.

(11) The tube 1 is heated, for instance, at a temperature of 190° C. for 30 minutes. The heating temperature may be in the range of 170° to 250° C.

(12) The tube 1 is cooled to room temperature.

(13) Silver is vacuum-deposited on the photocathode. The vacuum deposition of silver is carried out while the sensitivity of the photocathode is being measured. The vacuum deposition is suspended when the sensitivity has reached a peak.

(14) The tube 1 is sealed and disconnected from the gas evacuating device. The photoelectric tube 1 is then complete.

Figure 1:
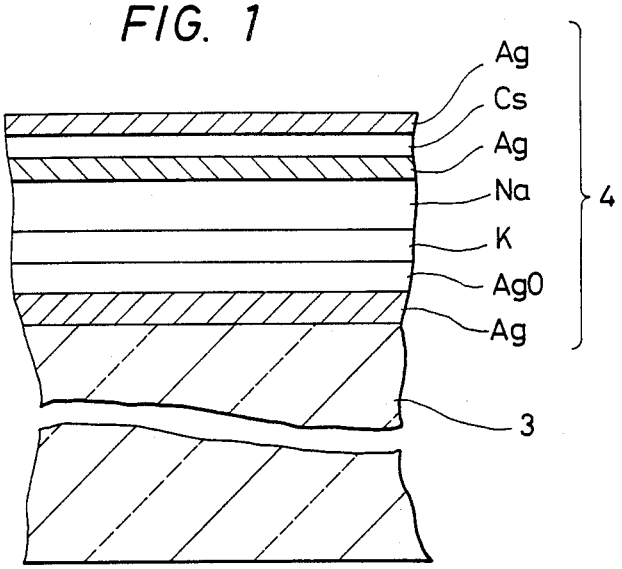
FIG. 1 is an enlarged sectional view showing a part of a photocathode according to the invention.

As is apparent from the above description, the photoelectric tube 1 has the photocathode on the substrate which, as shown in FIG. 1, is composed of a first silver layer, a silver oxide layer, a potassium layer, a sodium layer, a second silver layer, a cesium layer, and a third silver layer.

Figure 3:
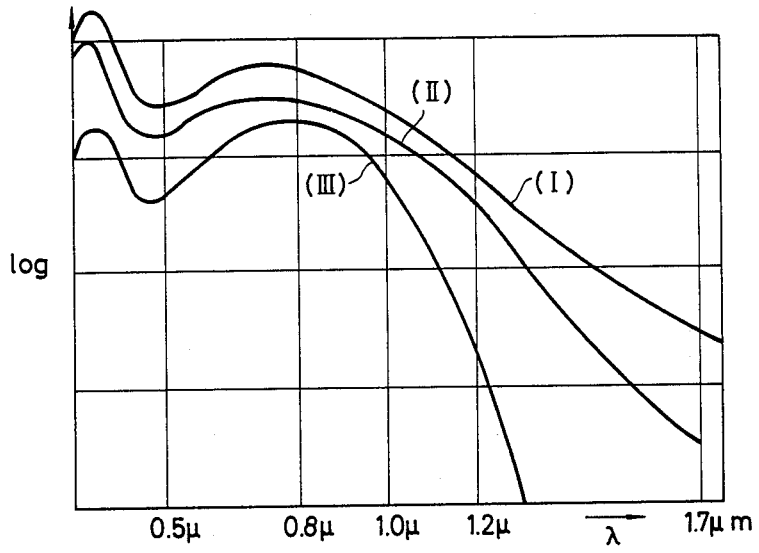
FIG. 3 is a graphical representation for a comparison of the spectral sensitivity characteristics of the photocathode of the invention with those of conventional photocathodes.

FIG. 3 shows the spectral sensitivity characteristics of a photocathode (I) formed as described above according to the invention, a photocathode (II) ) of silver, silver oxide, potassium and cesium as previously proposed, and a conventional silver-oxygen-cesium (Ag-O-Cs) photocathode (III) as described above. In FIG. 3, the horizontal axis represents wavelength and the vertical axis (logarithmic scale) photo-current output per unit incident energy. As is clear from the graphical representation of FIG. 3, the spectral sensitivity characteristic of the photocathode according to the invention is superior to those of the conventional photocathodes.

Figure 4:
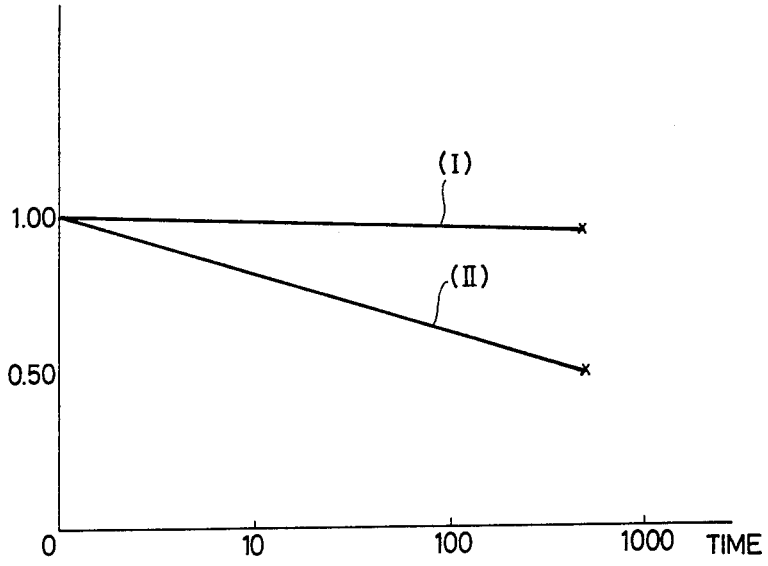
FIG. 4 is a graphical representation for a comparison of the service life of the photocathode of the invention with that of the conventional photocathode.

FIG. 4 is a graphical representation provided for a comparison of the service life of the photocathode (I) according to the invention with that of the conventional photocathode (II) of silver, silver oxide, potassium and cesium. This graphical representation was produced according to the following method: Two photoelectric tubes which were of the same configuration but which had different photocathodes were manufactured. A light beam from a 0.1 lumen white lamp was applied to each of the photoelectric tubes with a voltage of 250 V applied across the photocathode 4 and the anode 5. The output current of the anode 5 was plotted with time. In FIG. 4, the initial value of the output current is normalized to one.

As is apparent from the above description, according to the method of the invention, the silver layer is oxidized, and the potassium layer, the sodium layer, the silver layers and the cesium layer are formed to thus provide a novel photocathode which has an improved optical sensitivity for long wavelengths. Therefore, the photocathode according to the invention can be extensively employed for the measurement of infrared rays.

I claim:

1. A photocathode comprising:

a transparent substrate;

a first silver layer formed on said transparent substrate;

a silver oxide layer formed on said first silver layer;

a potassium layer formed on said silver oxide layer;

a sodium layer formed on said potassium layer;

a second silver layer formed on said sodium layer;

a cesium layer formed on said second silver layer; and a third silver layer formed on said cesium layer.

* * * * *